US006837964B2

(12) United States Patent
Franklin et al.

(10) Patent No.: US 6,837,964 B2
(45) Date of Patent: Jan. 4, 2005

(54) INTEGRATED PLATEN ASSEMBLY FOR A CHEMICAL MECHANICAL PLANARIZATION SYSTEM

(75) Inventors: Timothy J. Franklin, Campbell, CA (US); Dan A. Marohl, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/293,542

(22) Filed: Nov. 12, 2002

(65) Prior Publication Data

US 2003/0066604 A1 Apr. 10, 2003

Related U.S. Application Data

(62) Division of application No. 09/931,156, filed on Aug. 16, 2001, now Pat. No. 6,503,131.

(51) Int. Cl.[7] ..... B24B 21/20
(52) U.S. Cl. ..... 156/345.2; 156/345.13
(58) Field of Search ..... 156/345.2, 345.13

(56) References Cited

U.S. PATENT DOCUMENTS

| | | | | |
|---|---|---|---|---|
| 1,353,967 | A | 9/1920 | Lorenz | |
| 1,665,749 | A | 4/1928 | Mattison | |
| 2,646,654 | A | 7/1953 | Brink | 51/135 |
| 3,376,578 | A | 4/1968 | Sawyer | 346/29 |
| 3,929,551 | A | 12/1975 | Frantzen | 156/345 |
| 4,347,689 | A | 9/1982 | Hammond | 51/281 SF |

(List continued on next page.)

FOREIGN PATENT DOCUMENTS

| | | | |
|---|---|---|---|
| AT | 405 171 | 6/1999 | B67D/5/06 |
| DE | 1037308 | 1/1957 | |
| EP | 0 448 014 A2 | 9/1991 | G11B/15/43 |
| EP | 0517594 A1 | 12/1992 | B24B/37/04 |
| EP | 0653270 A1 | 5/1995 | B24B/37/04 |
| EP | 0696495 A1 | 2/1996 | B24B/37/04 |
| EP | 0756917 A1 | 2/1997 | B24B/37/04 |
| EP | 0770455 A1 | 5/1997 | B24B/37/04 |

(List continued on next page.)

OTHER PUBLICATIONS

*Butterfield, et al., "Platen With Web Release Apparatus"*, U.S. patent application No. 09/676,395, filed Sep. 29, 2000.

Li, et al., "Platen for Retaining Polishing Material", U.S. patent application No. 09/709,769, filed Nov. 10, 2000.

Franklin, et al., "Integrated Platen Assembly for a Chemical Mechanical Planarization System", U.S. patent application No. 09/931, 156, filed Aug. 16, 2001.

White, et al., "Web Lift System for Chemical Mechanical Planarization", U.S. patent application No. 09/651,657, filed Aug. 29, 2000.

International Search Report for corresponding PCT/US02/25665, dated Dec. 3, 2002 provided as concise explanation for AT 405,171.

PCT International Search Report dated Feb. 17, 2003 for PCT/US02/25665.

*Primary Examiner*—P. Hassanzadal
*Assistant Examiner*—Sylvia R. MacArthur
(74) *Attorney, Agent, or Firm*—Moser, Patterson & Sheridan

(57) ABSTRACT

A method and apparatus for supporting a web of polishing material are generally provided. In one embodiment, an apparatus for supporting a web of polishing material includes a web of polishing media having a first portion disposed across a support surface of a platen assembly and a second portion wound on a first roll coupled to the platen assembly. A tensioning mechanism is coupled to the platen assembly and adapted to tension the web of polishing media in response to a diameter of the second portion of the web of polishing material wound on the first roll.

22 Claims, 8 Drawing Sheets

U.S. PATENT DOCUMENTS

| | | | | | |
|---|---|---|---|---|---|
| 4,373,991 | A | | 2/1983 | Banks | 156/645 |
| 4,412,400 | A | | 11/1983 | Hammond | 51/58 |
| 4,521,995 | A | | 6/1985 | Sekiya | 451/388 |
| 4,571,799 | A | | 2/1986 | Chitayat | 29/149.5 A |
| 4,603,867 | A | | 8/1986 | Babb et al. | 279/3 |
| 4,642,943 | A | | 2/1987 | Taylor, Jr. | 51/135 R |
| 4,753,104 | A | | 6/1988 | Strozier | 72/457 |
| 4,910,155 | A | | 3/1990 | Cote et al. | 437/8 |
| 4,918,870 | A | | 4/1990 | Torbert et al. | 51/131.3 |
| 5,036,630 | A | | 8/1991 | Kaanta et al. | 51/283 R |
| 5,065,547 | A | | 11/1991 | Shimizu et al. | 51/154 |
| 5,076,024 | A | | 12/1991 | Akagawa et al. | 51/209 DL |
| 5,081,795 | A | | 1/1992 | Tanaka et al. | 51/131.1 |
| 5,088,240 | A | | 2/1992 | Ruble et al. | 51/165.71 |
| 5,099,615 | A | * | 3/1992 | Ruble et al. | 451/5 |
| 5,197,999 | A | | 3/1993 | Thomas | 51/298 |
| 5,209,027 | A | | 5/1993 | Ishida et al. | 51/283 R |
| 5,212,910 | A | | 5/1993 | Breivogel et al. | 51/398 |
| 5,216,843 | A | | 6/1993 | Breivogel et al. | 51/131.1 |
| 5,232,875 | A | | 8/1993 | Tuttle et al. | 437/225 |
| 5,234,867 | A | | 8/1993 | Schultz et al. | 437/225 |
| 5,276,999 | A | | 1/1994 | Bando | 51/62 |
| 5,299,393 | A | | 4/1994 | Chandler et al. | 51/272 |
| 5,329,732 | A | | 7/1994 | Karlsrud et al. | 51/131.5 |
| 5,335,453 | A | | 8/1994 | Baldy et al. | 51/67 |
| 5,377,451 | A | | 1/1995 | Leoni et al. | 451/287 |
| 5,384,986 | A | | 1/1995 | Hirose et al. | 451/444 |
| 5,398,459 | A | | 3/1995 | Okumura et al. | 451/41 |
| 5,399,125 | A | | 3/1995 | Dozier | 474/117 |
| 5,423,716 | A | | 6/1995 | Strasbaugh | 451/388 |
| 5,476,413 | A | | 12/1995 | Hasegawa et al. | 451/168 |
| 5,486,129 | A | | 1/1996 | Sandhu et al. | 451/5 |
| 5,487,697 | A | | 1/1996 | Jensen | 451/324 |
| 5,490,808 | A | | 2/1996 | Jantschek et al. | 451/59 |
| 5,498,196 | A | | 3/1996 | Karlsrud et al. | 451/11 |
| 5,498,199 | A | | 3/1996 | Karlsrud et al. | 451/289 |
| 5,516,400 | A | | 5/1996 | Pasch et al. | 156/636.1 |
| 5,522,965 | A | | 6/1996 | Chisholm et al. | 156/636.1 |
| 5,527,209 | A | | 6/1996 | Volodarsky et al. | 451/388 |
| 5,527,424 | A | | 6/1996 | Mullins | 156/636.1 |
| 5,529,638 | A | | 6/1996 | Lutz | 134/6 |
| 5,531,861 | A | | 7/1996 | Yu et al. | 156/636.1 |
| 5,533,923 | A | | 7/1996 | Shamouilian et al. | 451/41 |
| 5,536,202 | A | | 7/1996 | Appel et al. | 451/285 |
| 5,542,874 | A | | 8/1996 | Shikaki | 451/158 |
| 5,547,417 | A | | 8/1996 | Breivogel et al. | 451/58 |
| 5,548,505 | A | | 8/1996 | Simmons et al. | 364/130 |
| 5,549,511 | A | | 8/1996 | Cronin et al. | 451/281 |
| 5,554,064 | A | | 9/1996 | Breivogel et al. | 451/41 |
| 5,554,065 | A | | 9/1996 | Clover | 451/283 |
| 5,558,563 | A | | 9/1996 | Cote et al. | 451/41 |
| 5,558,568 | A | | 9/1996 | Talieh et al. | 451/303 |
| 5,562,524 | A | | 10/1996 | Gill, Jr. | 451/1 |
| 5,562,529 | A | | 10/1996 | Kishii et al. | 451/36 |
| 5,564,965 | A | | 10/1996 | Tanaka et al. | 451/287 |
| 5,569,062 | A | | 10/1996 | Karlsrud | 451/285 |
| 5,575,706 | A | | 11/1996 | Tsai et al. | 451/41 |
| 5,578,529 | A | | 11/1996 | Mullins | 437/228 |
| 5,582,534 | A | | 12/1996 | Shendon et al. | 451/41 |
| 5,593,344 | A | | 1/1997 | Weldon et al. | 451/296 |
| 5,593,537 | A | | 1/1997 | Cote et al. | 156/636.1 |
| 5,595,529 | A | | 1/1997 | Cesna et al. | 451/291 |
| 5,597,346 | A | | 1/1997 | Hempel, Jr. | 451/287 |
| 5,599,423 | A | | 2/1997 | Parker et al. | 156/636.1 |
| 5,605,499 | A | | 2/1997 | Sugiyama et al. | 451/443 |
| 5,611,943 | A | | 3/1997 | Cadien et al. | 216/88 |
| 5,624,299 | A | | 4/1997 | Shendon | 451/28 |
| 5,635,083 | A | | 6/1997 | Breivogel et al. | 216/88 |
| 5,643,044 | A | | 7/1997 | Lund | 451/5 |
| 5,643,053 | A | | 7/1997 | Shendon | 451/28 |
| 5,643,056 | A | | 7/1997 | Hirose et al. | 451/41 |
| 5,643,067 | A | | 7/1997 | Katsuoka et al. | 451/444 |
| 5,645,471 | A | | 7/1997 | Strecker | 451/59 |
| 5,660,581 | A | | 8/1997 | Shin et al. | 451/289 |
| 5,676,590 | A | | 10/1997 | Hiraoka | 451/287 |
| 5,679,064 | A | | 10/1997 | Nishi et al. | 451/288 |
| 5,692,947 | A | | 12/1997 | Talieh et al. | 451/41 |
| 5,704,827 | A | | 1/1998 | Nishi et al. | 451/285 |
| 5,718,620 | A | | 2/1998 | Tanaka et al. | 451/288 |
| 5,722,877 | A | | 3/1998 | Meyer et al. | 451/41 |
| 5,738,574 | A | | 4/1998 | Tolles et al. | 451/288 |
| 5,759,918 | A | | 6/1998 | Hoshizaki et al. | 438/692 |
| 5,762,536 | A | | 6/1998 | Pant et al. | 451/6 |
| 5,791,969 | A | * | 8/1998 | Lund | 451/5 |
| 5,792,709 | A | | 8/1998 | Robinson et al. | 438/692 |
| 5,795,218 | A | | 8/1998 | Doan et al. | 451/526 |
| 5,800,248 | A | | 9/1998 | Pant et al. | 451/41 |
| 5,851,136 | A | | 12/1998 | Lee | 451/9 |
| 5,853,317 | A | | 12/1998 | Yamamoto | 451/288 |
| 5,871,390 | A | | 2/1999 | Pant et al. | 451/5 |
| 5,873,769 | A | | 2/1999 | Chiou et al. | 451/7 |
| 5,897,426 | A | | 4/1999 | Somekh | 451/41 |
| 5,899,801 | A | | 5/1999 | Tolles et al. | 451/288 |
| 5,906,532 | A | | 5/1999 | Nakajima et al. | 451/41 |
| 5,916,012 | A | | 6/1999 | Pant et al. | 451/41 |
| 5,921,852 | A | | 7/1999 | Kimura et al. | 451/285 |
| 5,954,912 | A | | 9/1999 | Moore | 156/345 |
| 5,961,372 | A | | 10/1999 | Shendon | 451/41 |
| 5,997,348 | A | | 12/1999 | Shepherd | 451/41 |
| 6,022,807 | A | | 2/2000 | Lindsey, Jr. et al. | 438/693 |
| 6,033,293 | A | | 3/2000 | Cravasse et al. | 451/494 |
| 6,062,959 | A | | 5/2000 | Weldon et al. | 451/307 |
| 6,068,542 | A | | 5/2000 | Hosokai | 451/37 |
| 6,102,777 | A | | 8/2000 | Duescher | 451/36 |
| 6,135,859 | A | | 10/2000 | Tietz | 451/41 |
| 6,149,506 | A | | 11/2000 | Duescher | 451/59 |
| 6,207,572 | B1 | * | 3/2001 | Talieh | 438/692 |
| 6,220,942 | B1 | | 4/2001 | Tolles et al. | 451/65 |
| 6,241,226 | B1 | | 6/2001 | Olsen et al. | 269/15 |
| 6,241,585 | B1 | | 6/2001 | White | 451/41 |
| 6,244,935 | B1 | | 6/2001 | Birang et al. | 451/41 |
| 6,273,796 | B1 | | 8/2001 | Moore | 451/56 |
| 6,273,800 | B1 | | 8/2001 | Walker et al. | 451/168 |
| 6,331,139 | B2 | | 12/2001 | Walker et al. | 451/490 |
| 6,379,221 | B1 | | 4/2002 | Kennedy et al. | 451/41 |
| 6,500,056 | B1 | * | 12/2002 | Krusell et al. | 451/302 |
| 6,602,110 | B2 | * | 8/2003 | Yi et al. | 451/9 |
| 6,612,914 | B2 | * | 9/2003 | Gurusamy et al. | 451/173 |

FOREIGN PATENT DOCUMENTS

| | | | | |
|---|---|---|---|---|
| EP | 0774323 | A2 | 5/1997 | B24B/37/04 |
| EP | 0774323 | A3 | 10/1997 | B24B/37/04 |
| EP | 0818272 | A1 | 1/1998 | B24B/37/04 |
| EP | 0 818 272 | | 1/1998 | B24B/37/04 |
| EP | 1 031 398 | | 8/2000 | B24B/37/04 |
| EP | 1 052 059 | | 11/2000 | B24B/37/04 |
| JP | 59037051 | | 2/1984 | B24B/55/06 |
| JP | 60228070 | | 11/1985 | B24B/37/04 |
| JP | 62-162466 | | 7/1987 | |
| JP | 2-269553 | | 11/1990 | |
| JP | 03131464 | | 6/1991 | B24B/21/20 |
| JP | 4-53682 | | 2/1992 | |
| JP | 4-250967 | | 9/1992 | |
| JP | 7-111256 | | 4/1996 | |
| JP | 09029634 | | 2/1997 | B24B/53/00 |
| JP | 9-225821 | | 2/1997 | |
| JP | 9248753 | | 9/1997 | B24B/21/00 |
| WO | WO 93/02837 | | 2/1993 | B24B/3/00 |

* cited by examiner

INTEGRATED PLATEN ASSEMBLY FOR A CHEMICAL MECHANICAL PLANARIZATION SYSTEM

This application is a division of co-pending U.S. patent application Ser. No. 09/931,156, filed Aug. 16, 2001 now U.S. Pat. No. 6,503,131, which is hereby incorporated by reference in its entirety.

BACKGROUND OF THE DISCLOSURE

1. Field of the Invention

Embodiments of the invention generally relate to a system and a method for supporting a web in a polishing system.

2. Background of Invention

In semiconductor wafer processing, the use of chemical mechanical planarization, or CMP, has gained favor due to the enhanced ability to increase device density on a semiconductor workpiece, or substrate, such as a wafer. As the demand for planarization of layers formed on wafers in semiconductor fabrication increases, the requirement for greater system (i.e., process tool) throughput with less wafer damage and enhanced wafer planarization has also increased.

CMP systems generally include a polishing head, a platen and polishing material disposed on the platen. A substrate retained in the polishing head is pressed against the polishing material and moved relative to the polishing material in the presence of a polishing fluid. Abrasives, typically contained in the polishing fluid or polishing material, remove material from the surface of the substrate synergistically with the chemical activity provided by the polishing fluid.

One type of polishing material that includes abrasives disposed therein is known as abrasive sheet material. The abrasive sheet material comprises a plurality of abrasive particles suspended in a resin binder that is disposed in discrete elements on a backing sheet. As the abrasive particles are contained in the polishing material itself, systems utilizing abrasive sheet material generally use polishing fluid that do not contain abrasives. Such polishing fluids enhance the service life of their fluid delivery systems.

Abrasive sheet polishing material is generally available in stick-down form but is often utilized in the form of a web. Generally, the web is periodically advanced over the course of polishing a number of substrates as the polishing surface of the web is consumed by the polishing process. A vacuum is typically applied between the web and platen to fix the web to the platen during the polishing process wherein the platen and web are related. When the web is advanced, the vacuum is removed, freeing the web from the platen's surface.

However, indexing the web across a polishing platen is sometimes difficult. Polishing debris and other contaminants may clog the vacuum system and prevent the removal of the vacuum between the web and platen. Additionally, fluids that come in contact with the web may cause surface tension or attraction to develop between the web and the underlying surface of the platen. This surface tension must be overcome to accomplish advancement of the web. If the attraction between the web and platen is great, the indexing means may not be able to index the web or the web may become damaged during the indexing process.

Providing a cushion of gas between the web and platen assists in overcoming the attraction between the web and platen. The gas lifts the web to a spaced-apart relation to the platen where the web may be freely indexed. However, providing gas to the area between the web and platen is complicated, and requires rotary union and process tubing to be routed through an already crowded platen.

Therefore, there is a need for an improved platen assembly for handling a web of polishing material in a polishing system.

SUMMARY OF INVENTION

In one aspect of the invention, an apparatus for supporting a web of polishing material is provided. In one embodiment, the apparatus includes a platen and a blocker valve. The platen includes a support surface adapted to support the polishing material and a port fluidly coupled to the support surface. A housing that includes a supply port, vacuum port and an exit port has a venturi body disposed therein. The vacuum port is fluidly coupled to the port disposed in the platen. The venturi body has first aperture that is fluidly coupled to the vacuum port and a second aperture that is disposed proximate the exit port of the housing. The blocker valve has a first state whereby a flow through the housing and blocker valve causes a vacuum to be drawn through the port disposed in the platen by the venturi body. In another embodiment, the flow through the venturi may be reversed by changing the state of the blocker valve to blow air through the port disposed in the platen, thereby placing the polishing material and the support surface of the platen in a spaced-apart relation.

In another aspect of the invention, method for supporting a web of polishing material is provided. In one embodiment, the method includes the steps providing a polishing material disposed on a plate, generating a vacuum between the polishing material and the platen by flowing a fluid through a venturi in a first direction and removing the vacuum by flowing the fluid through the venturi in a second direction. In another embodiment the method further comprises the step of removing the vacuum includes blowing the fluid between the platen and polishing material.

In another aspect of the invention, an apparatus for supporting a web of polishing material is provided. In one embodiment, an an apparatus for supporting a web of polishing material includes a web of polishing media having a first portion disposed across a support surface of a platen assembly and a second portion wound on a first roll coupled to the platen assembly. A tensioning mechanism is coupled to the platen assembly and adapted to tension the web of polishing media in response to a diameter of the second portion of the web of polishing material wound on the first roll

BRIEF DESCRIPTION OF DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION OF INVENTION

Figure 1:
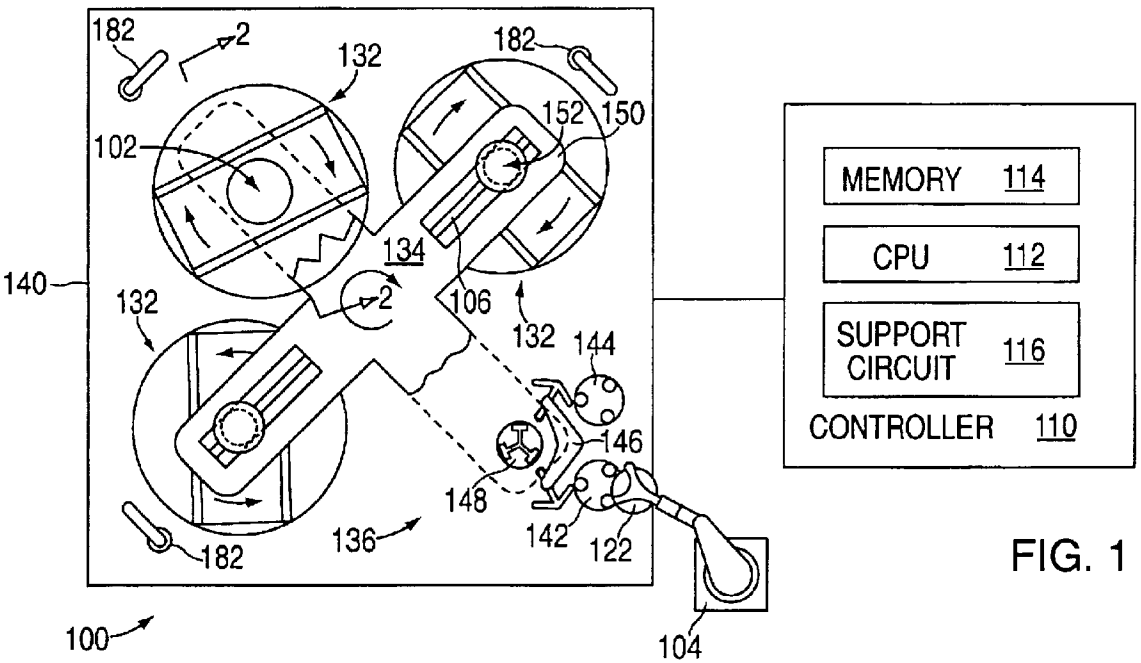
FIG. 1 is a plan view of a chemical mechanical planarization system of the invention.

FIG. 1 depicts a plan view of one embodiment of a chemical mechanical polisher 100 having a polishing material handling system that may include a vacuum system and/or an indexing system. One polisher 100 that can be used to advantage with the present invention is a REFLEXION™ Chemical Mechanical Polisher, manufactured by Applied Materials, Inc., located in Santa Clara, Calif. Although the polishing material handling system is described on one configuration of a chemical mechanical polisher, one skilled in the art may advantageously adapt embodiments of polishing material handling system as taught and described herein to be employed on other chemical mechanical polishers that utilize polishing material, and particularly polishing material in web form.

An exemplary polisher 100 is generally described in U.S. patent application Ser. No. 09/244,456, filed Feb. 4, 1999 to Birang et al., which is incorporated herein by reference in its entirety. The polisher 100 generally comprises a loading robot 104, a controller 110, a transfer station 136, a plurality of polishing stations 132, a base 140 and a carousel 134 that supports a plurality of polishing heads 152. Generally, the loading robot 104 is disposed proximate the polisher 100 and a factory interface (not shown) to facilitate the transfer of substrates 122 therebetween.

The transfer station 136 generally includes a transfer robot 146, an input buffer 142, an output buffer 144 and a load cup assembly 148. The input buffer station 142 receives a substrate 122 from the loading robot 104. The transfer robot 146 moves the substrate 122 from the input buffer station 142 and to the load cup assembly 148 where it may be transferred between the polishing head 152. An example of a transfer station that may be used to advantage is described in U.S. Pat. No. 6,156,124, issued Dec. 5, 2000, which is incorporated herein by reference in its entirety.

To facilitate control of the polisher 100 as described above, the controller 110 comprising a central processing unit (CPU) 112, support circuits 116 and memory 114, is coupled to the polisher 100. The CPU 112 may be one of any form of computer processor that can be used in an industrial setting for controlling various polishers, drives, robots and subprocessors. The memory 114 is coupled to the CPU 112. The memory 114, or computer-readable medium, may be one or more of readily available memory such as random access memory (RAM), read only memory (ROM), floppy disk, hard disk, or any other form of digital storage, local or remote. The support circuits 116 are coupled to the CPU 112 for supporting the processor in a conventional manner. These circuits include cache, power supplies, clock circuits, input/output circuitry, subsystems, and the like.

Generally, the carousel 134 has a plurality of arms 150 that each support one of the polishing heads 152. Two of the arms 150 depicted in FIG. 1 are shown in phantom such that the transfer station and a polishing material 102 disposed on one of the polishing stations 132 may be seen. The carousel 134 is indexable such that the polishing heads 152 may be moved between the polishing stations 132 and the transfer station 136.

Generally, a chemical mechanical polishing process is performed at each polishing station 132 by moving the substrate 122 retained in the polishing head 152 relative to the polishing material 102 supported on the polishing station 132. The polishing material 102 may have a smooth surface, a textured surface, a surface containing abrasives or a combination thereof. Additionally, the polishing material 102 may be advanced across or releasably fixed to the polishing surface. Typically, the polishing material 102 is releasably fixed by adhesives, vacuum, mechanical clamps or by other holding methods to the polishing station 132.

The polishing material 102 may comprise a pad or a web. In the embodiment depicted in FIG. 2, the polishing material comprises abrasive sheet material. Abrasive sheet material generally includes a plurality of abrasive particles suspended in a resin binder that is disposed in discrete elements on a backing sheet. The web of polishing material 102 may optionally comprise conventional polishing material without abrasives, for example, polyurethane foam available from Rodel Inc., of Newark, Del.

Returning to FIG. 1, a conditioning device 182 is generally disposed on the base 140 adjacent each polishing station 132. The conditioning device 182 periodically conditions the polishing material 102 to maintain uniform polishing results.

The polishing head 152 is generally coupled to the carousel 134 by a drive system 106. The drive system 106 generally provides motion to the polishing head 152 during processing. In one embodiment, the polishing head 152 is a TITAN HEAD™ wafer carrier manufactured by Applied Materials, Inc., Santa Clara, Calif. Generally, the polishing head 152 includes a recess (not shown) that retains the substrate 122 to the polishing head 152 during processing and transfer between stations. A retaining ring (also not shown) circumscribes the polishing head 152 to retain the substrate 122 within the recess of the polishing head 152 while polishing.

Figure 2:
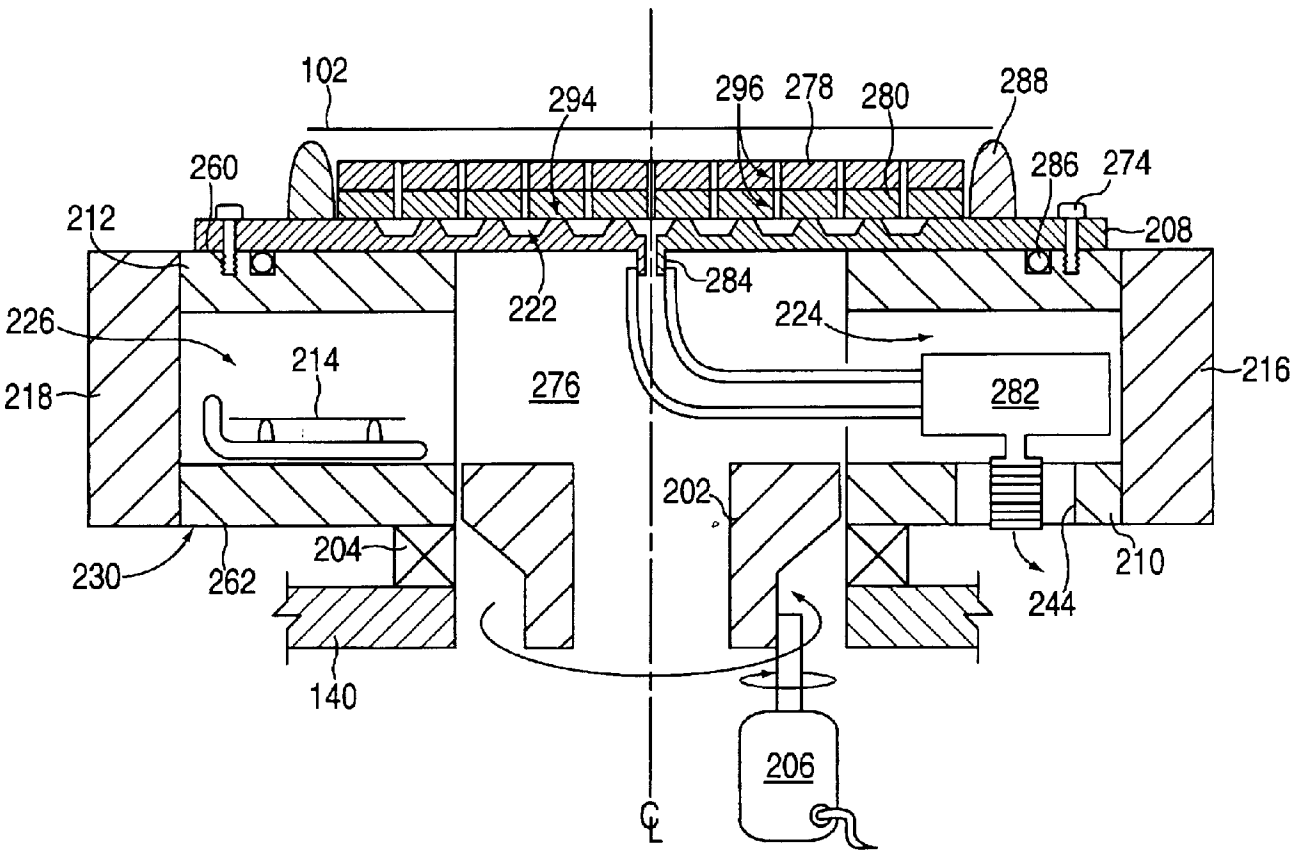
FIG. 2 is a sectional view of one embodiment of a polishing station.

FIG. 2 depicts a sectional view of the polishing station 132. The polishing station 132 generally includes a hub 202 coupled to a platen 230 that supports the polishing material 102. The platen 230 and hub 202 is supported above the base 140 by a bearing 204. The hub 202 and platen 230 may be optionally fabricated as a single unit. The hub 202 is coupled to the platen 230 at one end and is coupled to a drive system 206 (e.g., an electric motor) at the opposite end. The drive system 206 provides rotational motion to the hub 202, causing the platen 230 to rotate.

Generally, an area of the base 140 circumscribed by the bearing 204 is open and provides a conduit for the electrical, mechanical, pneumatic, control signals and connections communicating with the platen 230. Conventional bearings, rotary unions and slip rings (not shown) are provided such that electrical, mechanical, pneumatic, control signals and connections are coupled between the base 140 and the rotating hub 202 and platen 230.

Figure 6:
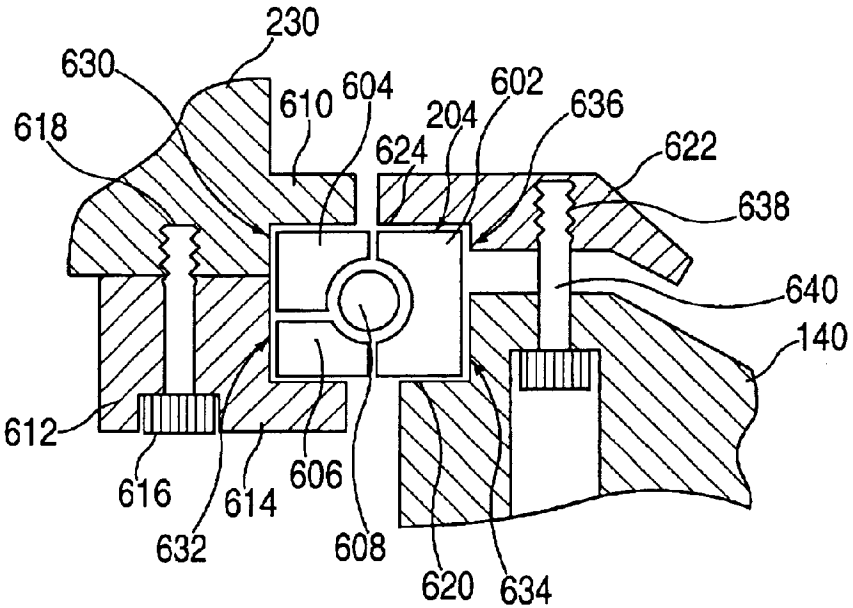
FIG. 6 is a partial sectional view of one embodiment of a platen assembly supported by a bearing.

FIG. 6 depicts one embodiment of the platen 230 supported by the bearing 204. Generally, the bearing 204 includes an outer race 602, an inner upper race 604 and an inner lower race 606 that capture a plurality of balls 608. The inner upper and lower races 604, 606 are clamped between the platen 230 and an inner race clamp 612. The inner upper race 604 is seated between a flange 610 that extend radially outward from a perimeter 630 of the platen 230. The inner lower race 606 is seated between a flange 614 that extends radially outward from a perimeter 632 of the lower race clamp 612. A plurality of bolts 616 extend through the lower race clamp 612 and thread into a threaded hole 618 disposed in the platen 230.

The outer race 602 is generally clamped between the base 140 and an outer race clamp 622. The base 140 generally includes a ledge defined by cylindrical wall 634 and a land 620 on which the bearing 204 rests. The outer race clamp 622 generally includes a flange 624 that extends radially inwards from an inner diameter wall 636 of the outer race clamp 622. A fastener 640 disposed through the base 140 and into a threaded hole 638 formed in the outer race clamp 622 is tightened to clamp the outer race 602 of the bearing 204 between the flange 624 of the outer race clamp 622 and the land 620 of the base 140.

The bearing 204 is pre-loaded to provide proper function under operating conditions. The pre-loaded bearing 204 generally eliminates the need to carefully match the torque applied to the fasteners 640 without creating undesirable runout and vibration as the platen 230 rotates. Alternatively, conventional bearings may be utilized.

Returning to FIG. 2, the platen 230 generally includes a top surface 260, a first end 210, a second end 212 and a bottom surface 262. The top surface 260 generally has a hollow center passage 276 formed therethrough. The center passage 276 allows for fluid, electrical, sensor, control and other lines to be routed from the hub 202 to different areas of the platen 230.

A first cavity 224 and at least a second cavity 226 (both shown in phantom) are disposed in the platen 230 between the center passage 276 and a respective end 210, 212. The first cavity 224 generally houses a vacuum system 282 that is utilized to secure and optionally space the polishing material 102 from the platen 230. The first cavity 224 generally includes a passage 244 disposed through the platen 230 that connects the first cavity 224 to the bottom surface 262 of the platen 230. The passage 244 allows air, liquids and other contaminates exiting the vacuum system 282 to flow out the bottom surface 262 of the platen 230 and be captured by the system's central waste system (not shown) that is typically disposed in or on the base 140.

The second cavity 226 generally houses a printed circuit board (PCB) 214 that controls or interfaces with the vacuum system 282 and/or other devices disposed in the platen 230. The geometry of the platen 230, including the size and location of the cavities 224 and 226, along with the size, weight and location of the vacuum system 282 and PCB 214 are configured to substantially balance the platen 230 as the platen rotates. The rotational balance of the platen 230 extends the life of the bearing 204 while reducing vibration and runout of the platen 230 while rotating, thus enhancing polishing performance. Alternatively, the vacuum system 282 may be coupled to the bottom surface 262 of the platen 230, disposed in another position proximate the platen 230 or disposed remotely from the platen 230.

A first side rail 216 is coupled to the first end 210 while a second side rail 218 is coupled to the second end 212 of the platen 230. The rails 216, 218 generally support a web supply assembly 406 and a web take-up assembly 408 which are depicted in a plan view of the platen 230 of FIG. 4.

Figure 4:
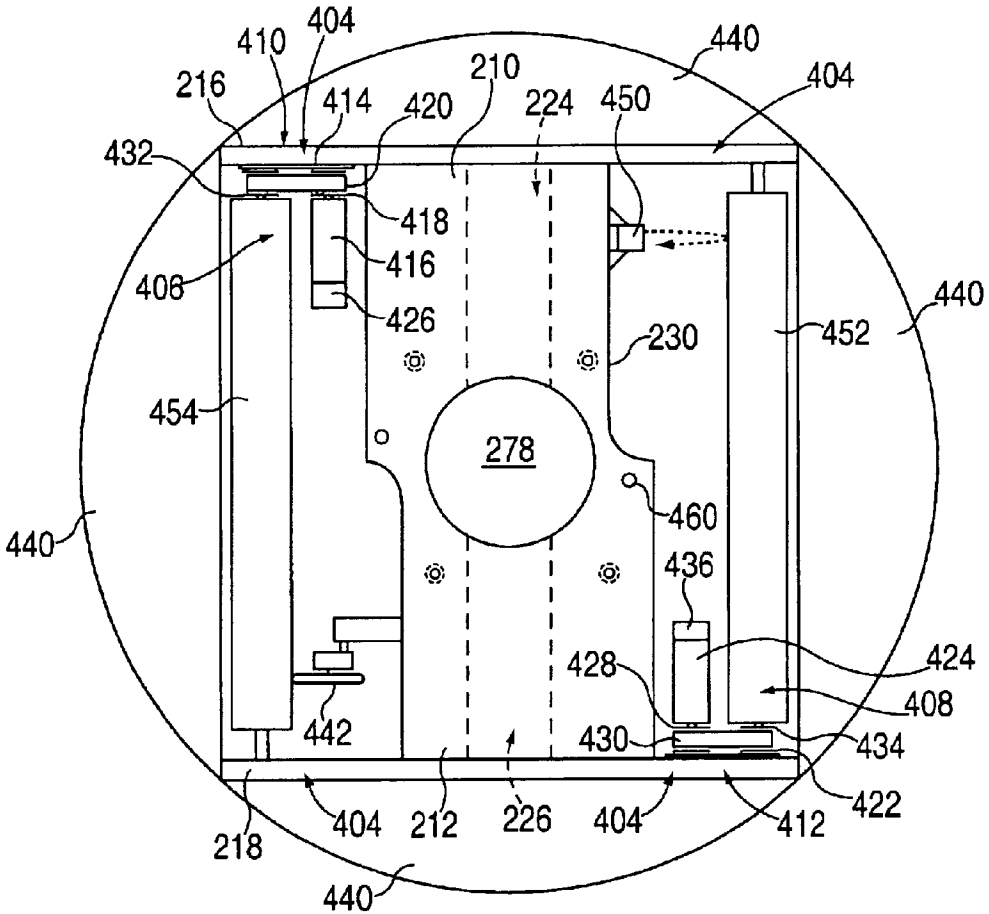
FIG. 4 is a plan view of one embodiment of a platen assembly.

Referring to FIG. 4, the rails 218 and 216 are coupled to the platen 230 and have end sections 404 that extend beyond the platen 230 to provide space of the web assemblies 406, 408. Mounted between one pair of end sections 404 between the rails 216, 218 is the web supply assembly 406. The web take-up assembly 408 is mounted between the other pair of end sections 404 on the opposite side of the platen 230. The web of polishing material 102 is disposed across the platen 230 between the web supply assembly 406 and web take-up assembly 408. Generally, the web supply assembly 406 holds an unused portion of the web of polishing material 102 while the web take-up assembly 408 holds a used portion of the web of polishing material 102.

A first web drive 410 is coupled to one of the side rails 216 or 218. The first web drive 410 generally tensions the web of polishing material 102 disposed across the platen 230. The first web drive 410 additionally permits the web of polishing material 102 to be unwound from the web supply assembly 406.

The first web drive 410 generally comprises a mounting pad 414 that supports a motor 416. The mounting pad 414 is coupled to the side rail 216 or 218. The motor 416 typically is an electric motor that incorporates a harmonic drive, however, other types of motors with or without gear reducers or with direct drives may be utilized. For example, solenoid, gear motors, hydraulic, electric motors, stepper, servo or air motors may be utilized. Disposed between the motor 416 and mounting pad 414 is a first pulley 418. The first pulley 418 drives a belt 420 that turns a second pulley 432. The second pulley 432 is coupled to a supply roll 454 that provides the rotary motion utilized to tension the web of polishing material 102 in the web supply assembly 406. The belt 420 is typically a timing belt. Optionally, the belt 420 and pulleys 418, 432 may be replaced with gears or other motion transfer devices. A portion or all of the web drive 410 may be disposed on the outside of the side rail 216.

A second web drive 412 is coupled on the opposite side of the platen 230 to one of the side rails 218. The second web drive 412 may be coupled to the same or opposite side rail that the first web drive 410 is coupled to. Generally, the second drive system 412 advances the web of polishing material 102 across the platen 230 from the web supply assembly 406 to the web take-up assembly 408. Alternatively, the web drives 410 and 412 may be coupled to the platen 230.

The second web drive 412 generally comprises a mounting pad 422 that supports a motor 424. The motor 424 is configured similarly to the motor 416. The mounting pad 422 is coupled to the side rail 218. The motor 424 is typically coupled to a brake 426 that selectively prevents rotation. The brake 426 is configured to prevent the motor 424 from rotating in a direction that would allow the web of polishing material 102 to unwind from the take-up assembly 408 as tension is applied by the web supply assembly 406. Alternatively, the motor 424, such as an electric motor, may be controlled to prevent rotation, for example, by application of a brake or electronically through the motor controls.

Disposed between the motor 424 and mounting pad 422 is a first pulley 428. The pulley 428 drives a belt 430 that turns a second pulley 434. The second pulley 434 is coupled to a take-up roll 452 that provides the rotary motion utilized to wind the web of polishing material 102 onto the web take-up assembly 408. The belt 430 is typically a timing belt. Optionally, the belt 430 and pulleys 428, 434 may be replaced with gears or other motion transfer devices.

A sensor 442 is typically coupled to the to one of the rails 216, 218 or the platen 230. The sensor 442 detects the surface of the polishing material 102 such that as the polishing material 102 advances, a change in the diameter of the polishing material 102 disposed on the supply roll 454 of the supply assembly 406 (or, alternatively, the take-up assembly 408) that corresponds to an amount of linear displacement of the polishing material 102 across the platen 230. The sensor 442 may be a rotary encoder, a proximity sensor, an optical sensor, a linear displacement transducer or other sensor for detecting a length of polishing material 102 as the web advances. Alternatively, the sensor 442 may be positioned to detect rotation of one of the rollers 504, 506, 514, 516 described below having the polishing material 102 running thereover may be utilized to determine the amount of polishing material 102 advanced.

A sensor 450 for detecting the diameter of the polishing material 102 wound on the supply assembly 406 is typically coupled to one of the rails 216, 218 or the platen 230. The sensor 450 detects the surface of the polishing material 102 such that as the polishing material 102 advances, a change in the diameter of the polishing material 102 disposed in the supply assembly 406.

A torque sensor 436 is typically coupled to the motor 416. Generally, torque information provided by the sensor 436 is utilized to tension and/or advance the polishing material 102. For example, as the motor 416 pulls the polishing material 102 against the brake 426, the sensor 436 provides the controller 110 with the torque applied to the polishing material 102. Using the diameter of the polishing material 102 disposed on the supply assembly 406 provided by the sensor 450, the tension of the polishing material 102 across the platen 230 may be resolved. The controller 110 then adjusts the torque of the motor 416 so that the tension applied to the polishing material 102 is maintained at a predetermined amount. To advance the polishing material 102, the sensors 436, 450 provides feedback to controller 110 to balance the force applied to the polishing material 102 by the motors 416, 424 so that the web of polishing material 102 may advance a predetermined amount as measured by sensor 442.

A plurality of guards 440 may be coupled exterior of the platen 230. The guards 440, which are generally semicircular in shape, give the platen 230 a circular plan form that shields the corners of the platen 230 during rotation.

Figure 5:
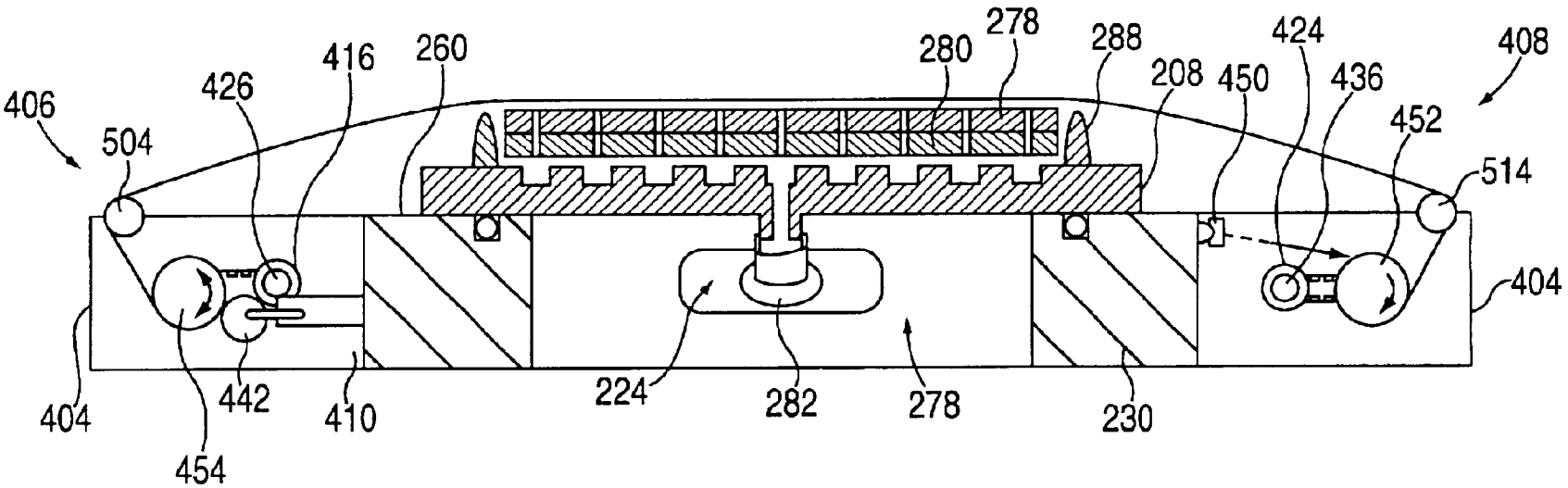
FIG. 5 is a sectional view of the platen of FIG. 4 depicting motion of a web.

Referring to FIG. 5, one embodiment of the web supply assembly 406 and the web take-up assembly 408 that illustrates the movement of the web of polishing material 102 across the platen 230. Generally, the web supply assembly 406 includes the supply roll 454, an upper guide member 504 and a lower guide member 506 that are disposed between the side rails 218. The supply roll 454 generally contains an unused portion of polishing material 102 and is configured so that it may easily be replaced with another supply roll 454 containing new polishing material 102 once the polishing material 102 disposed on the supply roll 454 has been consumed by the polishing process. One embodiment of a replaceable supply roll is disclosed in the previously incorporated U.S. patent application Ser. No. 09/244,456 to Birang et al.

The supply roll 454 generally interfaces with the pulley 432 that is coupled to the mounting pad 414. The belt 420 is disposed between the pulleys 418 and 432 such that the motion provided by the motor 416 is transferred to the supply roll 454.

The lower guide member 506 is positioned to lead the web of polishing material 102 from the supply roll 454 to the upper guide member 504. The upper guide member 504 is disposed between the side rails 216, 218 such that the polishing material 102 leading off the roller 504 is disposed substantially coplanar (i.e., lies immediately adjacent and parallel) to the top surface 260 of the platen 230. The guide members 504 and 506 may comprise a bar having a radius or chamfer that protects the polishing material 102 moving thereover from damage. Alternatively, the guide members 504 and 506 may comprise rollers or shafts to further facilitate travel of the polishing material 102 thereover.

Generally, the web take-up assembly 408 includes the take-up roll 452, an upper guide member 514 and a lower guide member 516 that are all disposed between the side rails 218. The take-up roll 452 generally contains a used portion of polishing material 102 and is configured so that it may easily be replaced with an empty take-up roll once take-up roll 452 is filled with used polishing material 102. The take-up roll 452 generally interfaces with the pulley 434 that is coupled to the mounting pad 422. The belt 430 is disposed between the pulleys 428 and 434 such that the motion provided by the motor 424 is transferred to the take-up roll 452.

The upper guide member 514 is positioned to lead the web of polishing material 102 from the platen 230 to the lower guide member 516. The lower guide member 516 leads the web of polishing material 102 onto the take-up roll 452. The guide members 514 and 516 may comprise a bar having a radius or chamfer that protects the polishing material 102 moving thereover from damage. Alternatively, the guide members 514 and 516 may comprise rollers or shafts to further ease the travel of the polishing material 102.

The web of polishing material 102 is generally moved in relation to the platen 230 by balancing the forces between the motor 416 coupled to the supply assembly 406 and the motor 424 coupled to the take-up assembly 408. For example, to advance the polishing material 102 across the platen 230, the motor 424 is driven to apply a greater force on the polishing material 102 than the motor 416. The pull of polishing material 102 by the take-up roll 452 exceeds the opposing force applied to the supply roll 454, thus causing the polishing material 102 to unwind from the supply roll 454 and be wound on the take-up roll 452.

The amount of polishing material 102 advanced is controlled using the sensor 442. The sensor 442 detects the length of the polishing material 102 unwound from the roll 454 as the polishing material 102 advances. Once the polishing material 102 advances a predetermined amount, the controller 110 causes brake 426 to be applied and the first motor 416 to pull the polishing material 102 against the brake 426.

The polishing material 102 is tensioned across the platen 230 by driving the motor 416 against the brake 426. The motor 416 pulls the polishing material 102 towards the supply roll 454. As the supply roll 454 is driven against the brake 426 disposed in the second drive system 412, the polishing material 102 is stretched tightly (i.e., tensioned) between the supply roll 454 and take-up roll 452. The torque sensor 436 monitors the torque applied by the motor 424. Using the roll diameter information provided by the sensor 450, the controller 110 is able to adjust the motor torque to allow a predetermined tension to be applied and maintained on the polishing material 102.

Returning to FIG. 2, a top plate 208 is generally disposed on the top surface 260 spanning the center passage 276. A subpad 278 and a subplate 280 are disposed on a center portion 294 of the top plate 208 and support the polishing material 102 thereon.

The subpad 278 is typically a plastic, such as polycarbonate or foamed polyurethane. Generally, the hardness or durometer of the subpad 278 may be chosen to produce a particular polishing result. The subpad 278 generally maintains the polishing material 102 parallel to the plane of the substrate 122 held in the polishing head 152 and promotes global planarization of the substrate 122. The subplate 280 is positioned between the subpad 278 and the bottom of the center passage 276 such that the upper surface of the subpad 278 is maintained coplanar with the top surface 260 of the platen 230.

Generally, the subpad 278 and subplate 280 contain a plurality of concentric passages or apertures 296 disposed therethrough. The apertures 296 allow a vacuum to be pulled through the subpad 278 thus securing the polishing material 102 thereto during processing.

The top plate 208 generally includes an annular gasket 288 disposed thereon that circumscribes the center portion 294 that supports the subpad 278 and subplate 280. The gasket 288 may be any form of seal such as a polymer sheet, o-ring or molded form, including those comprising spring elements. Generally, the gasket 288 is configured to have a height that extends above the subpad 278. In one embodiment, the gasket 288 has a parabolic shape which minimizes the contact area with the polishing material 102 when vacuum is applied to secure the polishing material 102. The gasket 288 is generally fabricated from a fluoropolymer, EDPM, EPR, VITON® or other elastomeric material compatible with the polishing fluids and able to substantially provide a vacuum seal against the backing material of the polishing material 102.

The gasket 288 is secured to the top plate 208 in a manner that prevents the gasket 288 from becoming dislodged as the polishing material 102 is advanced across the platen 230. For example, the gasket 288 may be press fit to the top plate 208, adhered to the top plate 208, vulcanized to the top plate 208, clamped to the top plate 208 or secured in another manner that prevents the gasket 288 from rolling or twisting or becoming unattached from the top plate 208 as the web of polishing material 102 is indexed. The gasket 288 should resists abrasion and particulate generation as the polishing material 102 is moved thereover.

An o-ring 286 or other seal is disposed between the top plate 208 and platen 230 to prevent fluids or other contamination from entering the center passage 276. The top plate 208 is typically removably fastened to the platen 230 by one or more fasteners 274 to allow the top plate 208 to be removed for cleaning, replacement or to allow access to the center passage 276.

The top plate 208 generally includes a vacuum port 284 formed therethrough which is coupled to a vacuum system 282. The vacuum system 282 generally applies a vacuum through the vacuum port 284 which evacuates a region between the polishing material 102 and the subpad 278 as fluids are pulled through the apertures 296 and out the vacuum port 284.

A network of open channels or grooves 222 are disposed generally disposed between the top plate 208 and subplate 280 to enhance the uniformity of the vacuum applied through the subpad 278. Typically, the grooves 222 are formed in the top plate 208 but may alternatively be partially or completely formed in the subplate 280.

Figure 7:
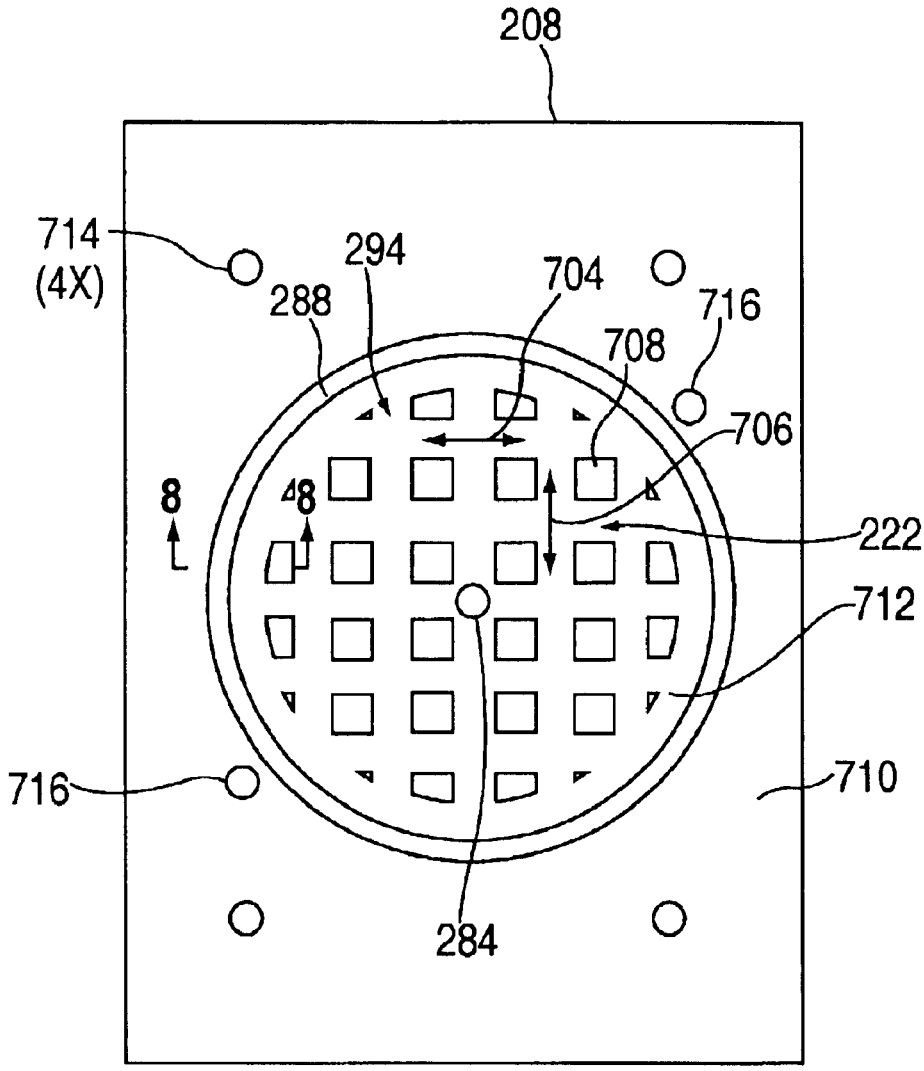
FIG. 7 is a plan view of one embodiment of a top plate.
Figure 8:
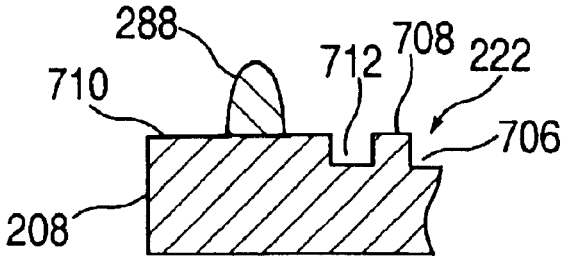
FIG. 8 is a partial sectional view of the top plate of FIG. 7 taken along section line 8—8.

In the embodiment depicted in FIGS. 7 and 8, the grooves 222 of the top plate 208 allow vacuum to be drawn across the central portion 294 of the top plate 208 from the vacuum port 284. The grooves 222 comprise a grid of lateral channels 704 and transverse channels 706 that insert to define a plurality of islands 708 that support the subplate 280. Optionally, an outer circumscribing channel 712 is disposed outward of the lateral and transverse channels 704, 706 that fluidly couple the outer ends of the lateral and transverse channels 704, 706. The lateral and transverse channels 704, 706 generally are formed in an upper surface 710 of the top plate 208 so that at least one side of the channels 704, 706 are open. This allows the channels 704, 706 to be cleaned of any debris and contamination that may be drawn through the subpad 278 and subplate 280 by the vacuum, thus extending the service life of the top plate 208. The grooves 222 may alternatively be configured in any number of configurations including radial, random or other patterns.

The top plate 208 additionally includes a plurality of mounting holes 714 that facilitate securing the top plate 208 to the platen 230. Optionally, one or more locating features disposed in the platen 230 such as a dowel pin or tool ball (shown as 460 in FIG. 4) may be disposed through a hole or bushing 716 in the top plate 208 for positioning the top plate 208 relative to the platen 230.

Returning to FIG. 2, the vacuum port 284 is generally fluidly coupled through the grooves 222 disposed in the top plate 208 and apertures 296 disposed through subpad 278 and subplate 280 to the top surface 260. When a vacuum is drawn through the vacuum port 284, the air removed from between region of the subpad 278 and the polishing material 102 bounded by the gasket 288 causes the polishing material 102 to be firmly secured to the subpad 278 during polishing. An example of such polishing material retention system is disclosed in U.S. patent application Ser. No. 09/258,036, filed Feb. 25, 1999, by Sommer et al., which is hereby incorporated herein by reference in its entirety. The reader should note that other types of devices may be utilized to releasably fix the polishing material 102 to the platen 230, for example releasable adhesives, bonding, electrostatic chucks, mechanical clamps and other releasable retention mechanisms.

Optionally, to assist in releasing the polishing material 102 from the subpad 278 and platen 230 prior to advancing the polishing material 102, surface tension caused by fluid that may be disposed between the subpad 278 and the polishing material 102 is overcome by a blast of fluid (e.g., air) provided through the vacuum port 284 or other port (not shown) through the apertures 296 disposed in the subpad 278 by the vacuum system 282 (or other pump). The fluid pressure distributed through the channels 704, 706 of the top plate 208 moves uniformly through apertures 296 disposed in the subpad 278 and subplate 280 and lifts the polishing material 102 from the subpad 278 and the top surface 260 of the platen 230.

Alternatively, the subpad 278 may be a porous material that permits gas (e.g., air) to permeate therethrough and lift the polishing material 102 from the platen 230. Such a method for releasing the web of polishing material 102 is described in U.S. patent application Ser. No. 60/157,303, filed Oct. 1, 1999, by Butterfield, et al., and is hereby incorporated herein by reference in its entirety.

Figure 3A:
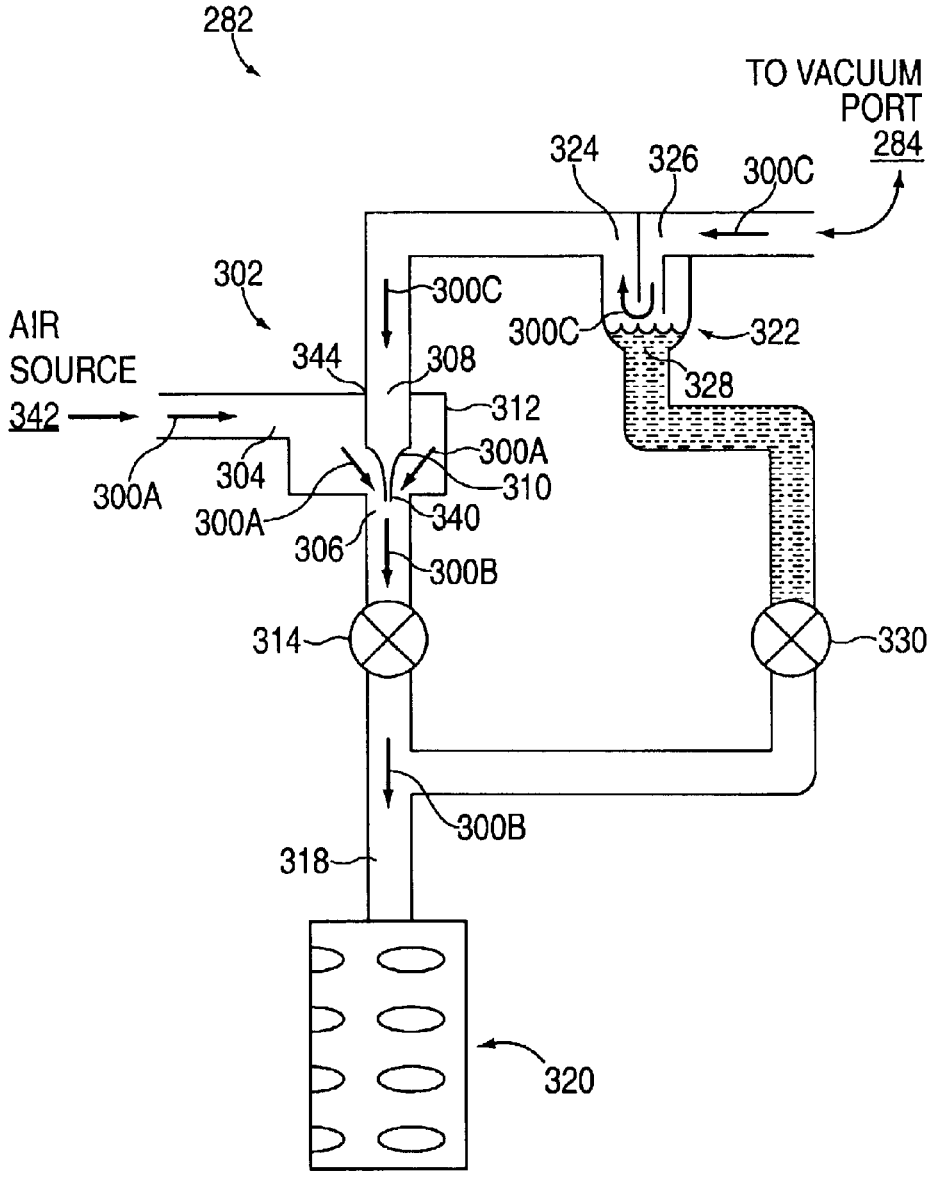
FIG. 3A is a flow schematic of the vacuum system in a first state.
Figure 3B:
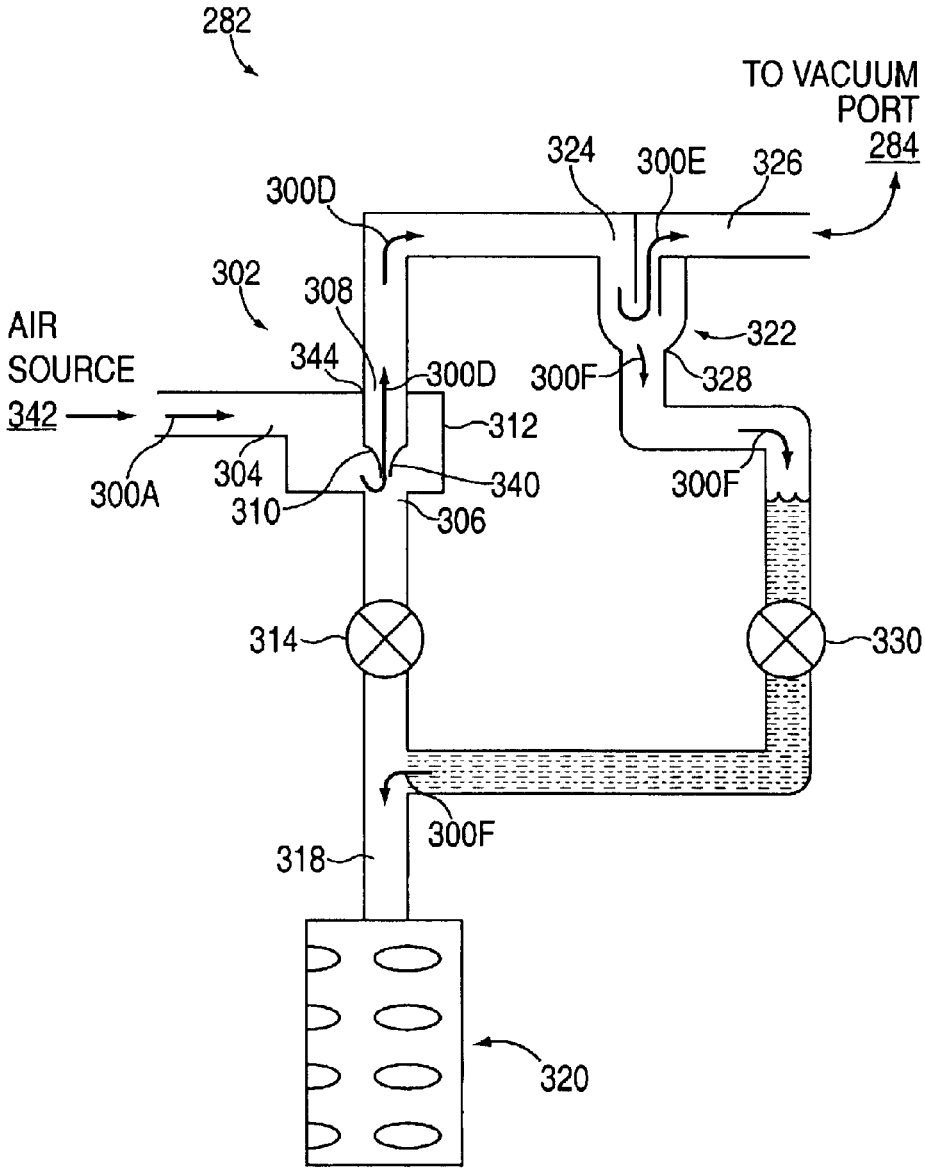
FIG. 3B is a flow schematic of the vacuum system of FIG. 3A in a second state.

FIG. 3A depicts a flow schematic of one embodiment of the vacuum system 282. Generally, the vacuum system 282 includes a venturi assembly 302 and a blocker valve 314. The blocker valve 314 is typically a 2-way solenoid valve however, other valves or series of valves for selectively re-directing flow through the venturi assembly 302 may be utilized. The blocker valve 314 may be switched between a first state which causes the venturi assembly 302 to generate a vacuum as shown in FIG. 3A and a second state which causes gas to be reversed through the venturi assembly 302 (as shown in FIG. 3B). Although the venturi assembly 302 is described with reference to a specific embodiment, other venturi assemblies 302 may be devised using the teachings described herein that are contemplated as within the scope of this disclosure.

In the embodiment shown in FIG. 3A, the venturi assembly 302 generally includes a housing 312 having a venturi body 310 disposed therein. The housing 312 is typically coupled to the underside of the platen 230. The housing 312 includes a supply port 304, a vacuum port 344 and an exit port 306. The supply port 304 is generally coupled through the rotary union of the platen 230 to an air source 342. The vacuum port 344 is generally coupled to the vacuum port 284 disposed in the platen 230. The exit port 306 is fluidly coupled through the blocker valve 314 to an exhaust port 318. The exhaust port 318 may be optionally coupled to a muffler 320 to minimize sound generation at the exhaust port 318. The exhaust port 318 and/or muffler 320 may be at least partially disposed through the passage 244 (as shown in FIG. 2).

The venturi body 310 generally includes a first aperture 308 and a second aperture 340. The first aperture 308 is fluidly coupled through the vacuum port 344 of the housing 312 to the port 284 disposed in the platen 230. The second aperture 340 is generally aligned with a flow path within the housing 312 between the supply port 304 and the exit port 306. The first aperture 308 generally has a greater sectional area than the second aperture 340. One venturi body 310 that may be adapted to benefit from the invention is the ZN series venturi, available from SMC Corporation of America, headquartered in Indianapolis, Ind.

The blocker valve 314 is typically disposed between the exit port 306 of the venturi assembly 302 and the exhaust port 318, and, when in the first state, allows fluid to pass from the assembly 302 to the exhaust port 318. In a second state, the blocker valve 314 prevents flow between the exit port 306 and the exhaust port 318. The blocker valve 314 is generally a two-way valve such as a solenoid, gate, diaphragm, plug, ball or other valve configured to prevent flow between the exit port 306 and exhaust port 318.

As fluid, such as air (indicted by reference numeral 300*a*), is passed through the housing 312 from the supply port 304 and out the exit port 306, fluid (i.e., air indicated by reference numeral 300*c*) is pulled through the venturi body 310 from the first aperture 308 to the second aperture 340 by a venturi effect. The combined flow 300*b* passes through the blocker valve 314 and exits the system 282 through the exhaust port 318 and muffler 320. The flow 300*c* pulls air and liquid from between the platen 230 and polishing material 102 creating a vacuum therebetween that secures the polishing material 102 to the platen 230.

To keep fluid and other contamination entering the system 282 from contaminating and/or clogging the venturi 310, a water trap 322 may be disposed between the vacuum port 284 and the first aperture 308 of the venturi assembly 302. Typically, the water trap 322 is coupled proximate the vacuum port 284. The water trap 322 generally removes liquids and other contamination from the flow 300*a*.

In the embodiment depicted in FIG. 3A, the water trap 322 generally includes an inlet port 326, an outlet port 324 and a drain port 328. The inlet port 326 is typically coupled to the vacuum port 284 while the outlet port 324 is typically coupled to the first aperture 308 of the venturi assembly 302. The drain port 328 is typically coupled to the exhaust port 318. A shut off valve 330 is generally disposed between the drain port 328 and the exhaust port 318. While a vacuum is drawn through from the vacuum port 284, the shut off valve 330 is maintained in a closed state to prevent fluids and contaminants captured by the water trap 322 from being drawn into the venturi 310. As the vacuum system 282, along with the efficiency of the fluid distribution plate through the top plate 208 and subpad 278, secures the web of polishing material 102 firmly to the platen 230 with such force that polishing may occur without tensioning the web of polishing material 102.

FIG. 3B depicts the vacuum system 282 configured to provide pressured fluid to the vacuum port 284 that causes the polishing material 102 to separate from the platen 230. In configuration, the blocker valve 314 is closed which directs the fluid flow 300*a* entering the venturi assembly 302 from the supply port 304 through the second aperture 340 (see flow 300*d*). The flow 300*d* passes through the water trap 322 and to the vacuum port 284.

If the shut off valve 330 is open as depicted in FIG. 3B, the flow 300*d* is split into a first flow portion 300*e* which flows out the inlet port 326 to the vacuum port 284 and a second flow portion 300*f* which drives the fluids and contaminants out the water trap 322 and to the exhaust port 318.

By reversing the flow through the venturi 310, the venturi 310 is substantially purged of contaminant build-up within the venturi 310 thereby advantageously extending the service interval and maintaining optimum flow performance. Moreover, the pressurized flow through the water trap 322 allows for periodic draining of the water trap 322 as part of the processing sequence without need for additional steps or maintenance.

Referring primarily to FIGS. 2, 3, 4 and 5, in one example of operation, the polishing material 102 is advanced across the platen 230 as follows. The vacuum applied between the platen 230 and the polishing material 102 is removed by actuating the blocker valve 314 to a second state that causes the flow through the venturi body 310 to reverse direction. The flow through the venturi body 310 in the reverse direction blows through the vacuum port 284 and is distributed by the grooves 222 to uniformly flow air out the apertures 296 disposed in the subpad 278. The flow lifts the polishing material 102 into a spaced-apart relation relative to the top surface 260 of the platen 230 and the subpad 278. In this spaced-apart position, the surface tension of fluids that may be disposed between the polishing material 102 and the platen 230 and/or subpad 278 is overcome facilitating movement of the polishing material 102 with minimal force and particulate generation.

The brake 426 is released and the force generated by the motor 424 disposed in the second drive system 412 is increased to overcome the force applied on the polishing material 102 by the motor 416. Alternatively, the force generated by the motor 416 may be decreased alone or in conjunction with the increase of the force generated by the motor 424 and/or the brake 426. The imbalance of force on the polishing material 102 causes an unused amount of polishing material 102 to unwind from the web supply assembly 406 and be wound upon the take-up roll 452 of the web take-up assembly 408.

The controller 110, in response to the signal generated from the sensors 442, 450, maintains the imbalance between the motors 416 and 424 to advance polishing material 102. The length may be determined by a change in roll diameter detected by sensor 450, or by the sensor 442 interfacing with the polishing material 102, supply or take-up roll 454, 452, or another roller over which the polishing material 102 travels. Once the predetermined length has been advanced, the controller 110 causes the motor 416 to generate a force upon the polishing material 102 that exceeds the force generated by the motor 424. The imbalance of forces causes the polishing material 102 to be pulled towards the web supply assembly 406. As the brake 426 is applied to prevent the polishing material 102 from advancing in that direction, the polishing material 102 is held tightly between the supply roll 454 and take-up roll 452.

The sensors 442, 450 provide the controller 110 with signals that are resolved to indicate the tension applied to the polishing material 102. The controller 110 adjusts the relative forces applied to the polishing material 102 by the motors 416, 424 to maintain a predetermined tension on the polishing material 102.

Although the teachings of the present invention that have been shown and described in detail herein, those skilled in the art can readily devise other varied embodiments that still incorporate the teachings and do not depart from the scope and spirit of the invention.

What is claimed is:

1. An apparatus for supporting a web of polishing material, comprising:

a platen assembly having a support surface;

a web of polishing material having a first portion disposed across the support surface and a second portion wound on a first roll coupled to the platen assembly;

a platen port disposed in the platen assembly and fluidly coupled to the support surface;

a venturi having a vacuum port fluidly coupled to the platen port, a pressure supply port and an exit port, wherein fluid flowing between the pressure supply port and the exit port pulls fluid through the vacuum port;

a valve fluidly coupled to the exit port, the valve having a first state that causes vacuum to be drawn through the vacuum port and a second state that causes flow from the vacuum port through the platen port; and a tensioning mechanism coupled to the platen assembly and adapted to tension the web of polishing material in response to a diameter of the second portion of the web of polishing material wound on the first roll.

2. The apparatus of claim 1, wherein the tensioning mechanism further comprises a sensor coupled to the platen assembly and adapted to provide a metric indicative of the diameter of the second portion of polishing material.

3. The apparatus of claim 1 further comprising:

a torque sensor adapted to provide a metric indicative of a torque applied to the first roll.

4. The apparatus of claim 3 further comprising:

a second roll coupled to the platen assembly opposite the first roll; and a brake adapted to control a rotation of the second roll.

5. The apparatus of claim 4 further comprising:

a first motor coupled to the first roll; and a second motor coupled to the second roll.

6. The apparatus of claim 1, wherein the platen assembly further comprises:

a platen;

a removable top plate disposed on the platen and having at least one vacuum port defined therein; and a gasket fixed to the top plate and circumscribing the vacuum port, the gasket bounding an evacuatable region defined between the top plate and the web of polishing material.

7. The apparatus of claim 6, wherein the gasket is vulcanized to the top plate.

8. The apparatus of claim 1, further comprising:

a first motor coupled to a first side of the platen assembly and adapted to drive the first roll;

a second motor coupled to a second side of the platen assembly and adapted to drive a second roll having a third portion of the web wound thereon; and wherein the tensioning mechanism comprises:

a torque sensor coupled to at least one of the first or second motor; and a first sensor coupled to the platen assembly and adapted to provide a metric indicative of a diameter of the first or second roll having the torque sensor coupled thereto.

9. The apparatus of claim 8, wherein the platen assembly further comprises:

a brake adapted to control rotation of the second motor.

10. The apparatus of claim 8, wherein the first motor and the first roll are coupled by a timing belt.

11. The apparatus of claim 8 further comprising a second sensor adapted to detect an amount of linear displacement of the web of polishing material across the support surface of the platen assembly.

12. The apparatus of claim 8, wherein the platen assembly further comprises:

a gasket fixed to the support surface of the platen assembly for sealing against the web of polishing material.

13. The apparatus of claim 12, wherein the platen assembly further comprises:

a platen; and a removable top plate disposed on the platen and having at least one vacuum port defined therein; the vacuum port adapted to evacuate a region defined between the top plate and the web of polishing material and circumscribed by the gasket.

14. The apparatus of claim 13, wherein the top plate further comprises:

a plurality of channels formed in a surface of the top plate facing the web of polishing material, wherein at least one of the channels is coupled to the vacuum port.

15. The apparatus of claim 14, wherein at least one of the plurality of channels is disposed concentrically inward of the gasket.

16. The apparatus of claim 12, wherein the gasket is vulcanized to an upper surface of the platen assembly.

17. The apparatus of claim 12, wherein the gasket is fabricated from at least one of a fluoropolymer, EDPM, EPR or VITON®.

18. An apparatus for supporting a web of polishing material, comprising:

a platen assembly having a support surface;

a web of polishing material having a first portion disposed across the support surface and a second portion wound on a first roll coupled to the platen assembly; and a tensioning mechanism coupled to the platen assembly and adapted to tension the web of polishing material in response to a diameter of the second portion of the web of polishing material wound on the first roll, wherein the platen assembly further comprises:

a platen;

a removable top plate disposed on the platen and having at least one vacuum port defined therein; and a gasket fixed to the top plate and circumscribing the vacuum port, the gasket bounding an evacuatable region defined between the top plate and the web of polishing material.

19. The apparatus of claim 18, wherein the gasket is vulcanized to the top plate.

20. An apparatus for supporting a web of polishing material, comprising:

a platen assembly having a support surface;

a web of polishing material having a first portion disposed across the support surface and a second portion wound on a first roll coupled to the platen assembly; and a tensioning mechanism coupled to the platen assembly and adapted to tension the web of polishing material in response to a diameter of the second portion of the web of polishing material wound on the first roll, wherein the platen assembly further comprises:

a platen; and a removable top plate disposed on the platen and having at least one vacuum port defined therein; the vacuum port adapted to evacuate a region defined between the top plate and the web of polishing material and circumscribed by the gasket.

21. The apparatus of claim 20, wherein the top plate further comprises:

a plurality of channels formed a surface of the top plate facing the web of polishing material, wherein at least one of the channels coupled to the vacuum port.

22. The apparatus of claim 20, wherein at least one of the plurality of channels is disposed concentrically inward of the gasket.

* * * * *

UNITED STATES PATENT AND TRADEMARK OFFICE

CERTIFICATE OF CORRECTION

PATENT NO. : 6,837,964 B2
APPLICATION NO. : 10/293542
DATED : January 4, 2005
INVENTOR(S) : Timothy J. Franklin and Dan A. Marohl It is certified that error appears in the above-identified patent and that said Letters Patent is hereby corrected as shown below:

Column 2, Line 41: Delete the second instance of "an"

Column 2, Line 49: Insert a period after "roll"

Column 9, Line 58: At the end of the line, delete "disposed"

Signed and Sealed this

Fifth Day of September, 2006

JON W. DUDAS
*Director of the United States Patent and Trademark Office*